US006861143B2

(12) United States Patent
Castellani et al.

(10) Patent No.: US 6,861,143 B2
(45) Date of Patent: Mar. 1, 2005

(54) CABLE WITH RECYCLABLE COVERING

(75) Inventors: Luca Castellani, Corsico (IT); Cristiana Scelza, Angellara Di Vallo Della Lucania (IT); Gaia Dell'Anna, Milan (IT); Enrico Albizzati, Lesa (IT)

(73) Assignee: Pirelli Cavi e Sistemi S.p.A., Milan (IT)

( * ) Notice: Subject to any disclaimer, the term of this patent is extended or adjusted under 35 U.S.C. 154(b) by 0 days.

(21) Appl. No.: 10/146,059

(22) Filed: May 16, 2002

(65) Prior Publication Data

US 2003/0008143 A1 Jan. 9, 2003

Related U.S. Application Data

(63) Continuation of application No. PCT/EP00/11193, filed on Nov. 13, 2000.

(60) Provisional application No. 60/166,423, filed on Nov. 19, 1999.

(30) Foreign Application Priority Data

Nov. 17, 1999 (EP) ..... 99122840

(51) Int. Cl.[7] ..... D02G 3/00; B05D 5/12

(52) U.S. Cl. ..... 428/379; 428/375; 428/372; 428/383; 174/113 R; 174/116; 174/110 PM; 174/102 SC; 427/118

(58) Field of Search ..... 174/113 R, 116, 174/102 SC, 110 PM, 110 SR, 120 SC, 120 SR; 428/379, 375, 372, 383; 427/118; 252/511

(56) References Cited

U.S. PATENT DOCUMENTS 5,747,621 A * 5/1998 Resconi et al. ..... 526/351
6,001,933 A * 12/1999 Tsuruoka et al. ..... 525/252
6,100,351 A * 8/2000 Sun et al. ..... 526/125.3
6,107,431 A * 8/2000 Resconi et al. ..... 526/351
6,156,846 A * 12/2000 Tsuruoka et al. ..... 525/240
6,162,548 A * 12/2000 Castellani et al. ..... 428/500
6,372,344 B1 * 4/2002 Castellani et al. ..... 428/379
6,410,651 B1 * 6/2002 Castellani et al. ..... 525/232
2002/0001715 A1 * 1/2002 Redondo et al. ..... 428/375
2002/0039653 A1 * 4/2002 Castellani et al. ..... 428/375
2003/0008143 A1 * 1/2003 Castellani et al. ..... 428/375

FOREIGN PATENT DOCUMENTS

| | | |
|---|---|---|
| EP | 0 475 306 A1 | 3/1992 |
| EP | 0 475 307 A1 | 3/1992 |
| EP | 0 527 589 A1 | 2/1993 |
| EP | 0 893 802 A1 | 1/1999 |
| WO | WO 96/23311 | 8/1996 |
| WO | WO 99/05688 | 2/1999 |
| WO | WO 02/03398 A1 * | 1/2002 |
| WO | WO 02/27731 A1 * | 4/2002 |

* cited by examiner

*Primary Examiner*—Rena Dye
*Assistant Examiner*—J. M. Gray
(74) *Attorney, Agent, or Firm*—Finnegan, Henderson, Farabow, Garrett & Dunner, L.L.P.

(57) ABSTRACT

A cable includes at least one conductor and at least one covering layer. The at least one covering layer includes a thermoplastic polymer material. The polymer material includes a propylene homopolymer or a copolymer of propylene with an olefin comonomer. The olefin comonomer is ethylene, one or more α-olefins other than propylene, or ethylene and one or more α-olefins other than propylene. The homopolymer or copolymer has a melting point between 140° C. and 165° C., a melting enthalpy between 30 J/g and 80 J/g, a boiling diethyl ether soluble fraction less than or equal to 12 wt % and melting enthalpy less than or equal to 4 J/g, a boiling n-heptane soluble fraction between 15 wt % and 60 wt % and melting enthalpy between 10 J/g and 40 J/g, and a boiling n-heptane insoluble fraction between 40 wt % and 8 wt % and melting enthalpy greater than or equal to 45 J/g.

33 Claims, 1 Drawing Sheet

CABLE WITH RECYCLABLE COVERING

CROSS-REFERENCE TO RELATED APPLICATIONS

This application is a continuation application of International Application No. PCT/EP00/11193, filed Nov. 13, 2000, in the European Patent Office, the contents of which are relied upon and incorporated herein by reference; additionally, Applicants claim the right of priority under 35 U.S.C. § 119(a)–(d) based on patent application No. 99122840.4, filed Nov. 17, 1999, in the European Patent Office; further, Applicants claim the benefit under 35 U.S.C. § 119(e) based on prior-filed, provisional application No. 60/166,423, filed Nov. 19, 1999, in the U.S. Patent and Trademark Office.

BACKGROUND OF THE INVENTION

1. Field of the Invention

This invention relates to a cable with recyclable covering.

In particular, the invention relates to a cable for transporting or distributing medium or high voltage electricity, comprising a layer of recyclable thermoplastic polymer covering with superior mechanical and electrical properties, enabling it, in particular to be used for high operating temperatures and for transporting electricity at high power.

2. Description of the Related Art

The requirement for products of considerable environmental compatibility, composed of materials which, in addition to not damaging the environment during production or utilization, can be easily recycled at the end of their life, is now fully accepted in the field of electrical and telecommunications cables.

However the use or materials compatible with the environment is conditioned by the need to limit costs while, for the more common uses, providing a performance equal to or better than that of conventional materials.

In the case of cables for transporting medium and high voltage electricity, the various coverings surrounding the conductor commonly consist of polyolefin-based crosslinked polymer, in particular crosslinked polyethylene (XLPE), or elastomeric ethylene/propylene (EPR) or ethylene/propylene/diene (EPDM) copolymers, also crosslinked. The crosslinking, effected during extrusion, gives the material satisfactory performance even under hot conditions during continuous use and with current overload.

It is well known however that crosslinked materials cannot be recycled, so that manufacturing scrap and the covering material of cables which have reached the end of their life can be disposed of only by incineration.

Moreover in some cases the external protection sheath of the cable is of polyvinylchloride (PVC), which if using conventional methods (for example by density difference in water) is difficult to separate from the crosslinked insulating material, in particular from crosslinked polyolefins containing mineral fillers (for example from ethylene/propylene rubber), neither can it be incinerated because combustion produces highly toxic chlorinated products.

There is therefore a need in the field of medium and high voltage electricity transport cables for insulating coverings consisting of recyclable polymers which have good electrical and mechanical properties.

Of uncrosslinked polymers, it s known to use high density polyethylene (HDPE) for covering high voltage cables. HDPE has however the drawback of a lower temperature than XLPE, both to current overload and during operation.

Thermoplastic low density polyethylene (LDPE) insulating coverings are also used in medium and high voltage cables. Again in this case, these coverings are limited by too low operating temperature (about 70° C.).

Another material potentially suitable for cable production is polypropylene (PP). In common use this term is used to indicate high crystalline isotactic PP, a thermoplastic material of high mechanical performance. In reality, isotactic PP cannot be used as a cable covering material, mainly because of its high rigidity, so that the attention of cable manufacturers has turned to other materials based on PP but possessing good flexibility (the so-called "flexible PPs").

For example, patent application WO 96/23311 describes a low voltage, high current cable in which the insulating covering, the inner sheath and the outer sheath are of the same uncrosslinked polymer, coloured black by the addition of carbon black. The use of the same material means that no separation of said components is required for recycling. For a maximum working temperature of 90° C. it is stated that heterophase thermoplastic elastomers can be used consisting of a polypropylene matrix within which an elastomeric phase of EPR or EPDM copolymers is dispersed.

Patent applications EP-A-475,306 and EP-A-475,307 describe a substantially amorphous elastomeric polypropylene homopolymer having a melting point between 145° C. and 165° C. and a heat of fusion between 4 and 10 cal/g and comprising a diethyl ether soluble fraction between 35 and 55%, this fraction having a relative viscosity of less than 1.0 dl/g and substantially no isotactic crystallinity. This polymer is produced by homopolymerization of propylene in the presence of a Ziegler-Natta catalytic system without electrondonors, comprising a solid catalyst based on titanium tetrahalide and aluminium trihalide supported on magnesium chloride, with aluminium trialkyl as co-catalyst. A potential use of the amorphous polymer so obtained is suggested for producing films.

Patent application EP-A-527,589 describes a polymer composition comprising: a) 20–80 wt % of an amorphous polyolefin comprising propylene and/or 1-butene in a quantity of at least 50 wt %, and b) 20–80 wt % of crystalline polypropylene. The composition is prepared by mechanically mixing amorphous polyolefin with the crystalline polypropylene. This composition is said to have excellent flexibility under cold conditions while maintaining the high hot mechanical strength typical of polypropylene, and hence suitable as an insulating material for cables.

The Applicant believes that the solutions already proposed for insulating medium or high voltage electric cables with a recyclable polymer are unsatisfactory. In particular, those polypropylene-based materials indicated in the prior art are unable to combine a mechanical performance which is satisfactory under both cold and hot conditions (in particular good mechanical strength and sufficient flexibility) with considerable electrical reliability.

In particular, heterophase materials such as the heterophase thermoplastic elastomers suggested in WO 96/23311 in which an elastomeric EPR or EPDM phase is dispersed in domains of the order of a few microns within a polypropylene matrix, are characterised by microscopic dishomogeneity, which can induce the formation or cavities at the interface between the elastomeric phase and the thermoplastic phase. With the passage of time and in the presence of an electrical field, these cavities can result in degradation of the material and hence perforation of the insulating layer.

The Applicant also believes that the amorphous polypropylenes, such as those described in EP-A-475,306 and EP-A-473,307, cannot satisfactorily be used for electric cable insulation. In this respect, as these materials have a high amorphous phase content for a low molecular weight, as indicated by the presence of a diethyl ether soluble fraction between 35 and 55 wt %, they show poor mechanical strength, in particular under hot conditions.

Again, the present applicant has found that granules produced by mechanically mixing amorphous polypropylene with isotactic polypropylene, as described for example in EP-A-527,589, show an oily surface and considerable stickiness on storage, clearly indicating partial insolubility between the two polymers with migration of the low molecular weight fractions towards the material surface. This problem results in numerous material processability problems, as the granules tend to pack together making it difficult, for example to feed the granules into an extruder. Moreover, in the finished article the presence of an oily low molecular weight product on the surface of the insulating layer can cause poor adhesion between the insulation and the semiconductive layers, with possible separation during cable operation and consequent partial discharges.

SUMMARY OF THE INVENTION

The Applicant has now found it possible to obtain excellent performance in terms of both mechanical and electrical properties by using as the recyclable polymer base material a single-phase thermoplastic propylene homopolymer or copolymer as hereinafter defined. This polymer material possesses good flexibility even under cold conditions, excellent mechanical strength and high electrical performance, such as to make it particularly suitable for forming at least one covering layer, and in particular an electrical insulating layer, of a medium or high voltage cable.

In particular, the polymer material of the invention has a microscopically homogenous structure and does not show undesirable migration of low molecular weight fractions onto the material surface.

According to a first aspect, the invention therefore provides a cable (1) comprising at least one conductor (2) and at least one covering layer (3, 4, 5, 7) based on a thermoplastic polymer material, wherein said material comprises a propylene homopolymer or a copolymer of propylene with an olefin comonomer chosen from ethylene and α-olefins other than propylene, said homopolymer or copolymer having:

- a melting point between 140 and 165° C.;
- a melting enthalpy between 30 and 80 J/g;
- a boiling diethyl ether soluble fraction of less than or equal to 12 wt %, preferably between 1 and 10 wt %, having a melting enthalpy of less than or equal to 4 J/g, and preferably less than or equal to 2 J/g;
- a boiling n-heptane soluble fraction of between 15 and 60 wt %, preferably between 20 and 50 wt %, having a melting enthalpy of between 10 and 40 J/g, and preferably between 15 and 30 J/g; and
- a boiling n-heptane insoluble fraction of between 40 and 85 wt %, preferably between 50 and 80 wt %, having a melting enthalpy greater than or equal to 45 J/g, and preferably between 50 and 95 J/g.

According to a preferred aspect, the propylene homopolymer or copolymer has a melt flow index (MFI), measured at 230° C. with a load of 21.6 N in accordance with ASTM D1238/L, of between 0.01 and 50 dg/min, and preferably between 0.5 and 10 dg/min.

Preferably, the olefin comonomer is present in a quantity less than or equal to 15 mol %, and more preferably less than or equal to 10 mol %. The olefin comonomer is preferably ethylene or an α-olefin of formula $CH_2{=}CH{-}R$, where R is a linear or branched $C_2$–$C_{10}$ alkyl chosen for example from 1-butene, 1-pentene, 4-methyl-1-pentene, 1-hexene, 1-octene, 1-decene, 1-dodecene and the like, or their combinations. Propylene/ethylene copolymers are particularly preferred.

According to a preferred aspect, the polymer base material of the invention has a flexural modulus, measured in accordance with ASTM D638, of between 15 and 900 MPa.

According to a further aspect, the invention relates to the use of a polymer material as heretofore described, as the base material for preparing a covering layer (4) with electrical insulation properties, or for preparing a covering layer (3, 5) with semiconductive properties, or for preparing a covering layer (7) acting as an outer protective sheath.

The propylene homopolymer or copolymer used in the invention shows a single-phase microscopic structure, ie substantially without heterogeneous phases dispersed within molecular domains of size greater than one micron. In this respect, the material does not show the optical phenomena typical of heterophase polymer materials, and in particular is characterised by better transparency and reduced local stress whitening.

The polymer material suitable for forming the cable of the invention can be prepared by homopolymerization of propylene or copolymerization of propylene with ethylene or an α-olefin other than propylene, in the presence of a Ziegler-Natta catalyst of low stereospecificity. In particular, the catalyst advantageously comprises:

a) a solid catalyst consisting of titanium tetrahalide (for example titanium tetrachloride), supported on $MgCl_2$, optionally mixed with aluminium trihalide (for example aluminium trichloride);

b) a co-catalyst consisting of aluminium trialkyl, where he alkyl groups are $C_1$–$C_9$ (for example aluminium triethyl or aluminium triisobutyl);

c) a Lewis a base in a quantity generally not greater than 10 mol % on the moles of aluminium trialkyl.

The addition of the Lewis base in a predetermined quantity enables the s stereoregularity of the obtained polymer to be controlled. The Lewis base is generally chosen from aromatic acid esters and alkoxysilanes, for example ethylbenzoate, methyl-p-toluate, diisobutylphthalate, diphenyldimtehoxysilane, or mixtures thereof.

The co-catalyst is added in strong excess over the solid catalyst. The molar ratio of titanium halide to aluminium trialkyl is generally between 50:1 and 600:1.

Further details regarding the production of the propylene homopolymers or copolymers of the invention are given for example by Albizzati et al. in "Polypropylene Handbook", Chapter 2, page 11 onwards (Hanser Publisher, 1996).

Homopolymers and copolymers of the aforesaid type suitable for implementing the invention are available commercially for example under the trademark Rexflex® of the Huntsman Polymer Corporation.

In forming a cable covering layer, other conventional components can be added to the polymer base material as heretofore defined, such as antioxidants, processing aids, water tree retardants, and the like.

Conventional antioxidants suitable for the purpose are for example distearylthio-propionate and pentaerithryl-tetrakis [3-(3,5-di-tertbutyl-4-hydroxyphenyl)propionate] and the like, or mixtures thereof.

Processing aids which can be added to the polymer base include, for example, calcium stearate, zinc stearate, stearic acid, paraffin wax and the like, or their mixtures.

With particular reference to medium and high voltage cables, the polymer materials as heretofore defined can be advantageously used to form an insulating layer. In this respect, as stated, these polymer materials present good mechanical characteristics both at ambient temperature and under hot conditions, and also present improved electrical properties, in particular they enable high operating temperature to be employed, even exceeding that of cables with coverings consisting of crosslinked polymer base materials.

The semiconductive layers of the cable of the invention can be formed by known methods, and advantageously consist of a polypropylene-based thermoplastic polymer material which ensures good adhesion to the insulating layer such as to prevent any separation which could result in premature ageing of the cable life.

According to a preferred aspect, at least one of the semiconductive layers of the cable of the invention comprises a propylene homopolymer or copolymer as heretofore described.

If a semiconductive layer is to be provided, a conductive filler, in particular carbon black, is generally dispersed within the polymer material in a quantity such as to provide the material with semiconductive characteristics (ie such as to obtain a resistivity of less than 5 Ohm.m at ambient temperature). This quantity is generally between 5 and 80 wt %, and preferably between 10 and 50 wt %, of the total weight of the mixture.

The ability to use the same type of polymer material for both the insulating layer and the semiconductive layers is particularly advantageous in producing cables for medium or high voltage, in that it ensures excellent adhesion between adjacent layers and hence better electrical behaviour, particularly at the interface between the insulating layer and the inner semiconductive layer, where the electrical field and hence the risk of partial discharges are higher.

According to a further preferred aspect, the invention provides a cable comprising not only the aforestated layers but also at least one layer a acting as an outer protective sheath and consisting of a thermoplastic polymer material for example a propylene homopolymer or copolymer, which can be for example the aforedefined polymer material of the invention.

According to the invention, the use of the aforedefined propylene polymers or copolymers in the covering of medium or high voltage cables means that flexible recyclable coverings are obtained with excellent electrical and mechanical properties.

In particular, an insulating layer formed using an aforedefined propylene homopolymer or copolymer can operate at relatively high operating temperature (as much as 105° C.) whereas in the case of XLPE the operating temperature cannot generally exceed 90° C.

The mechanical properties are accompanied by excellent electrical properties, for example a dielectric loss (tandelta) comparable with that of XLPE and substantially better than other types of flexible PP.

Because of their high operating temperature and low dielectric losses, the cables covered with this insulating layer can carry a greater power, for equal voltage, than that transportable by an XLPL covered cable.

For the purposes of the invention the term "medium voltage" generally means a voltage of between 1 and 35 kV, whereas "high voltage" means voltages higher than 35 kV.

Although this description is mainly focused on the formation of cables for transporting or distributing medium or high voltage electricity, the polymer material of the invention can be used for covering electrical devices in general and in particular cables of different type, for example low voltage cables, telecommunications cables or mixed electricity/telecommunications cables.

BRIEF DESCRIPTION OF THE DRAWINGS

Further characteristics will be apparent from the detailed description given hereinafter with reference to the enclosed drawing, on which.

DETAILED DESCRIPTION OF THE PREFERRED EMBODIMENTS

Figure 1:
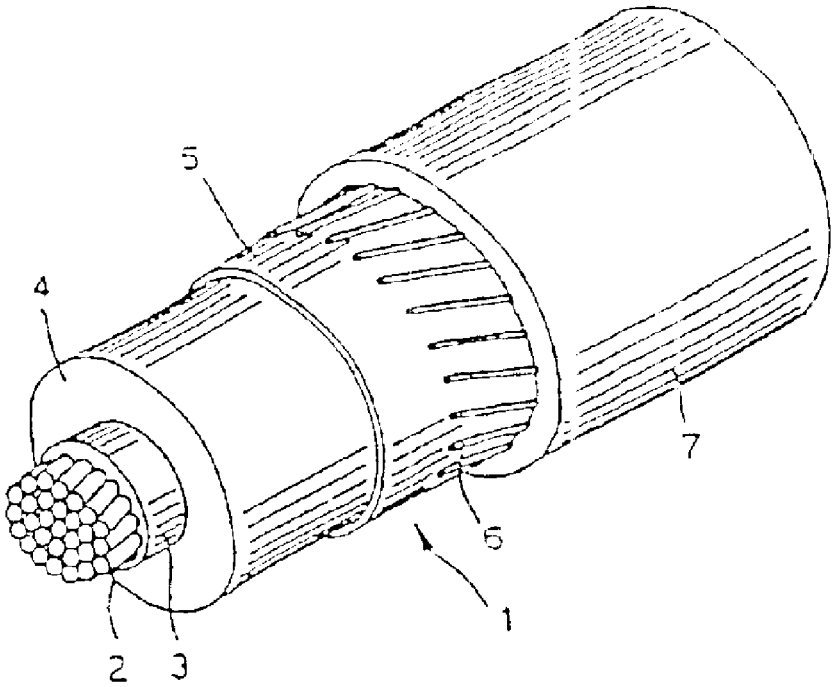
FIG. 1 is a perspective view of an electric cable, particularly suitable for medium or high voltage, according to the invention.

In FIG. 1, the cable 1 comprises a conductor 2, an inner layer with semiconductive properties 3, an intermediate layer with insulating properties 4, an outer layer with semiconductive properties 5, a metal screen 6, and an outer sheath 7.

The conductor 2 generally consists of metal wires, preferably of copper or aluminium, cabled together by conventional methods. At least one covering layer chosen from the insulating layer 4 and the semiconductive layers 3 and D comprises as its polymer base material a propylene homopolymer or copolymer as heretofore defined. Around the outer semiconductive layer 5 there is usually positioned a screen 6, generally of electrically conducting wires or strips wound helically. This screen is then covered by a sheath 7 of thermoplastic material, for example uncrosslinked polyethylene (PE) or a propylene homopolymer or copolymer as heretofore defined.

The cable of the invention can be constructed in accordance with known methods by depositing layers of thermoplastic material, for example by extrusion. Extrusion can take place in separate steps, by extruding the various layers separately onto the conductor. The extrusion is advantageously conducted in a single pass, for example by the tandem method in which individual extruders are arranged in series, or by co-extrusion with a multiple extrusion head.

FIG. 1 shows only one possible embodiment of a cable according to the invention. Suitable modifications known in the art can evidently be made to this embodiment, but without leaving the scope of the invention.

The following examples illustrate the invention, but without limiting it.

EXAMPLES

Table 1 shows the characteristics of two materials used as examples of the invention, and two materials used for comparison.

The two materials of the invention were Rexflex® WL 105 (propylene homopolymer) and Rexflex® WL 204 (propylene copolymer with 3.4 wt % of ethylene), both commercial products of the Huntsman Polymer Corp.

The two comparison materials were:

XLPE LE4201 (Borealis): crosslinked polyethylene commonly used for the insulating layer of medium or high voltage cables;

Hifax® CA12A (Montell): reactor-produced heterophase mixture consisting of an isotactic polypropylene matrix in which about 55 wt % of an EPR elastomeric phase (59 wt % of ethylene and 41 wt % of propylene) is dispersed.

The melt flow index (MFI) was measured at 230° C. and 21.6 N in accordance with ASTM D1238/L. The melting enthalpy and the melting point were measured by Mettler DCS instrumentation (second melting value) with a scanning rate of 10° C./min (instrument head type DSC 30, microprocessor type PC 11, Mettler software Graphware TA72AT.1). The flexural modulus was measured in accordance with ASTM D638.

TABLE 1

| Material | MFI | Melting point (° C.) | Melting enthalpy (J/gr) | Flexural modulus (MPa) |
|---|---|---|---|---|
| Rexflex ® WL105 | 1.8 | 158.4 | 56.8 | 290 |
| Rexflex ® WL204 | 1.7 | 148.4 | 48.4 | 152 |
| XLPE (LE4201) | 2.0 | 110.0 | — | 250 |
| Hifax ® CA12A | 0.9 | 165.0 | 35.4 (*) | 350 |

(*) relative only to the polypropylene phase

The polymers of the invention were extracted with boiling diethyl ether and n-heptane. The soluble fractions and the residue after extraction with n-heptane had the characteristics shown in Table 2.

The solvent extractions were carried out under reflux for 16 hours on 6 gram samples of material as such in the form of granules, using a Kumagawa extractor. That portion of the sample extracted by the solvent is the soluble fraction, the insoluble fraction being that remaining in the extractor.

TABLE 2

| Fraction | unit | Rexflex ® WL 105 | Rexflex ® WL 204 |
|---|---|---|---|
| 1. soluble in diethyl ether | wt % | 3.0 | 8.0 |
| 1. melting point | ° C. | n.d. | n.d. |
| 1. melting enthalpy | J/g | n.d. | n.d. |
| 2. soluble in n-heptane | wt % | 31.0 | 48.0 |
| 2. melting point | ° C. | 103.6 | 105.0 |
| 2. melting enthalpy | J/gr | 24.0 | 21.0 |
| 3. insoluble in n-heptane | wt % | 69.0 | 52.0 |
| 3. melting point | ° C. | 160.3 | 148.4 |
| 3. melting enthalpy | J/g | 76.0 | 71.8 |

n.d.: not determinable

Plates of 0.5 mm thickness were formed from the materials shown in Table 1. The Reflex® WL105 and Hifax® CA12A plates were moulded at 195° C. with 15 min preheating, while the Reflex® WL204 plates were moulded at 180° C. The XLPE was moulded at 130° C., crosslinked under pressure at 180° C. for 30 minutes, and finally degassed in an oven to eliminates peroxide decomposition products.

The plates obtained in this manner were subjected to dielectric loss measurement by measuring the tangent of the loss angle (tandelta) (in accordance with ASTM D150) at various temperatures and at various gradients (G). The measurements at G=10 kV/mm were effected under a pressure of 25 bar of nitrogen. The results are given in Table 3.

Measurements of resistance to thermopressure at 130° C. were also effected (in accordance with CEI 20-11, 2nd method) on the materials of the invention. The results are given in Table 3 and compared with the same measurement on XLPE. The test consists of subjecting a material test piece of defined thickness to predefined pressure and temperature and measuring its residual thickness after one hour. The resistance to thermopressure is the residual thickness expressed as a percentage of the initial thickness. This test evaluates the capacity of the material to withstand mechanical deformation under hot conditions, in particular at the maximum allowable temperature for a cable operating under overload.

TABLE 3

| | Rexflex ® WL105 | Rexflex ® WL204 | Hifax ® CA12A | XLPE (LE 4201) |
|---|---|---|---|---|
| Tandelta × $10^{-4}$ (G = 1 kV/mm @ 50 Hz) | | | | |
| 20° C. | <1 | 3 | 3 | 2 |
| 60° C. | <1 | 1 | — | <1 |
| 90° C. | <1 | 1 | 21 | <1 |
| 130° C. | 2 | 1 | — | <1 |
| Tandelta × $10^{-4}$ (G = 10 kV/mm @ 50 Hz) | | | | |
| 20° C. | 1 | — | — | 3 |
| 130° C. | 1 | — | — | <1 |
| Resistance to thermopressure (%) | 94 | 92 | — | 68 |

The polymer material of the invention demonstrates dielectric losses substantially equivalent to XLPE and significantly better than a reactor-produced heterophase mixture, in particular within the most important temperature range for cable operation, ie between 20 and 90° C.

From the measurements of resistance to thermopressure, it can be seen that although the materials of the invention have similar or higher flexibility than XLPE, they are characterised by lesser deformability than XLPE at high temperature.

Production of a Cable

A medium voltage cable prototype was constructed in which the insulating layer and semiconductive layers had the product Rexflex® WL204 of the invention as their base material.

The semiconductive composition, prepared using a 1.6 liter Banbury mixer with a volumetric filling coefficient of about 75%, consisted of:

| | |
|---|---|
| Rexflex ® WL204 | 100 phr |
| Nero Y-200 | 55 " |
| Irganox ® PS802 | 0.6 " |
| Irganox ® 1010 | 0.3 " |

Nero Y-200: acetylene carbon black from the firm SN2A with a specific surface of 70 $m^2/g$;

Irganox® PS802: distearylthiopropionate (DSTDP) (antioxidant of Ciba-Geigy);

Irganox® 1010: pentaerithryl-tetrakis[3-(3,5-di-tertbutyl-4-hydroxyphenyl)propionate] (antioxidant of Ciba-Geigy).

The cable was prepared by co-extruding the three layers through a triple head extruder onto a 1/0 AWG conductor consisting of a cord of aluminium wires of about 54 $mm^2$ cross-section. The extruder, with an inner diameter of 80 mm, had the following temperature profile: from 140° C. to 190° C. within the cylinder, 190° C. on the collar, and 190° C. at the head. The line speed was 2 m/min. The cable obtained in this manner had an insulating layer of 4.6 mm thickness and an inner and outer semiconductive layer of 0.5 mm thickness.

Samples were taken with hand punches from the insulating layer and semiconductive layers to determine their mechanical characteristics (in accordance with CEI 20–34 section 5.1) with an Istron instrument at a draw speed of 50 mm/min.

The results are given in Table 4.

TABLE 4

| | Semiconduct. layer | Insulating layer |
|---|---|---|
| Stress at break (MPa) | 13.4 | 18 |
| Elongation at break (%) | 177.0 | 750 |
| Modulus at 2.5% (MPa) | 5.9 | — |
| Modulus at 10% (MPa) | 11.5 | — |

In the cable produced in this manner, excellent adhesion was observed between the semiconductive layers and the insulating layer, both at ambient temperature and at 90° C.

What is claimed is:

1. A cable, comprising:

at least one conductor; and at least one covering layer;

wherein the at least one covering layer comprises a thermoplastic polymer material, wherein the thermoplastic polymer material comprises:

a propylene homopolymer; or a copolymer of propylene with an olefin comonomer;

wherein the olefin comonomer is ethylene, one or more α-olefins other than propylene, or ethylene and one or more α-olefins other than propylene, wherein the propylene homopolymer or copolymer of propylene has:

a melting point between 140° C. and 165° C.;

a melting enthalpy between 30 J/g and 80 J/g;

a boiling diethyl ether soluble fraction less than or equal to 12 wt %, wherein the boiling diethyl ether soluble fraction has a melting enthalpy less than or equal to 4 J/g;

a boiling n-heptane soluble fraction between 15 wt % and 60 wt %, wherein the boiling n-heptane soluble fraction has a melting enthalpy between 10 J/g and 40 J/g; and a boiling n-heptane insoluble fraction between 40 wt % and 85 wt %, wherein the boiling n-heptane insoluble fraction has a melting enthalpy greater than or equal to 45 J/g.

2. The cable of claim 1, wherein the boiling diethyl ether soluble fraction is between 1 wt % and 10 wt %, and wherein the boiling diethyl ether soluble fraction has a melting enthalpy less than or equal to 2 J/g.

3. The cable of claim 1, wherein the n-heptane soluble fraction is between 20 wt % and 50 wt %, and wherein the n-heptane soluble fraction has a melting enthalpy between 15 J/g and 30 J/g.

4. The cable of claim 1, wherein the n-heptane insoluble fraction is between 50 wt % and 80 wt %, and wherein the n-heptane insoluble fraction has a melting enthalpy between 50 J/g and 95 J/g.

5. The cable of claim 1, wherein the propylene homopolymer or copolymer of propylene has a melt flow index, measured according to ASTM D1238/L, between 0.01 dg/min and 50 dg/min.

6. The cable of claim 1, wherein the propylene homopolymer or copolymer of propylene has a melt flow index, measured according to ASTM D1238/L, between 0.5 dg/min and 10 dg/min.

7. The cable of claim 1, wherein the thermoplastic polymer material has a flexural modulus, measured according to ASTM D638, between 15 MPa and 900 MPa.

8. The cable of claim 1, wherein the olefin comonomer is present in a quantity less than or equal to 15 mol %.

9. The cable of claim 1, wherein the olefin comonomer is present in a quantity of less than or equal to 10 mol %.

10. The cable claim 1, wherein the olefin comonomer is ethylene.

11. The cable claim 1, wherein the olefin comonomer is one or more α-olefins other than propylene.

12. The cable claim 1, wherein the olefin comonomer is one α-olefin other than propylene.

13. A cable, comprising:

at least one conductor; and at least one covering layer;

wherein the at least one covering layer comprises a thermoplastic polymer material, wherein the thermoplastic polymer material comprises:

a copolymer of propylene with an olefin comonomer;

wherein the olefin comonomer is ethylene and one or more α-olefins other than propylene, wherein the propylene homopolymer or copolymer of propylene has:

a melting point between 140° C. and 165° C.;

a melting enthalpy between 30 J/g and 80 J/g;

a boiling diethyl ether soluble fraction less than or equal to 12 wt %, wherein the boiling diethyl ether soluble fraction has a melting enthalpy less than or equal to 4 J/g;

a boiling n-heptane soluble fraction between 15 wt % and 60 wt %, wherein the boiling n-heptane soluble fraction as a melting enthalpy between 10 J/g and 40 J/g; and a boiling n-heptane insoluble fraction between 40% and 85 wt %, wherein the boiling n-heptane insoluble fraction has a melting enthalpy greater than or equal to 45 J/g.

14. A cable, comprising:

at least one conductor; and at least one covering layer;

wherein the at least one covering layer comprises a thermoplastic polymer material, wherein the thermoplastic polymer material comprises:

a copolymer of propylene with an olefin comonomer;

wherein the olefin comonomer is ethylene and one α-olefins other than propylene, wherein the propylene homopolymer or copolymer of propylene has:

a melting point between 140° C. and 165° C.;

a melting enthalpy between 30 J/g and 80 J/g;

a boiling diethyl ether soluble fraction less than or equal to 12 wt %, wherein the boiling diethyl ether soluble fraction has a melting enthalpy less than or equal to 4 J/g;

a boiling n-heptane soluble fraction between 15 wt % and 60 wt %, wherein the boiling n-heptane soluble fraction has a melting enthalpy between 10 J/g and 40 J/g; and a boiling n-heptane insoluble fraction between 40 wt % and 85 wt %, wherein the boiling n-heptane insoluble fraction has a melting enthalpy greater than or equal to 45 J/g.

15. A cable, comprising:

at least one conductor; and at least one covering layer;

wherein the at least one covering layer comprises a thermoplastic polymer material, wherein the thermoplastic polymer material comprises:

a copolymer of propylene with an olefin comonomer;

wherein the olefin comonomer is one or more α-olefins of formula $CH_2$=CH—R, and wherein R is a linear or branched $C_2$–$C_{10}$ alkyl, wherein the propylene homopolymer or copolymer of propylene has:

a melting point between 140° C. and 165° C.;

a melting enthalpy between 30 J/g and 80 J/g;

a boiling diethyl ether soluble fraction less than or equal to 12 wt %, wherein the boiling diethyl ether soluble fraction has a melting enthalpy less than or equal to 4 J/g;

a boiling n-heptane soluble fraction between 15 wt % and 60 wt %, wherein the boiling n-heptane soluble fraction has a melting enthalpy between 10 J/g and 40 J/g; and a boiling n-heptane insoluble fraction between 40 wt % and 85 wt %, wherein the boiling n-heptane insoluble fraction has a melting enthalpy greater than or equal to 45 J/g.

16. The cable of claim 15, wherein the olefin comonomer is one or more of 1-butene, 1-pentene, 1-hexene, 1-heptene, 1-octene, 1-nonene, 1-decene, 1-undecene, 1-dodecene, and 4-methyl-1-pentene.

17. The cable of claim 15, wherein the olefin comonomer is one of 1-butene, 1-pentene, 1-hexene, 1-heptene, 1-octene, 1-nonene, 1-decene, 1-undecene, 1-dodecene, and 4-methyl-1-pentene.

18. A cable, comprising:

at least one conductor; and at least one covering layer;

wherein the at least one covering layer comprises a thermoplastic polymer material, wherein the thermoplastic polymer material comprises:

a copolymer of propylene with an olefin comonomer;

wherein the olefin comonomer is ethylene and one or more α-olefins of formula $CH_2$=CH—R, and wherein R is a linear or branched $C_2$–$C_{10}$ alkyl, wherein the propylene homopolymer or copolymer of propylene has:

a melting point between 140° C. and 165° C.;

a melting enthalpy between 30 J/g and 80 J/g;

a boiling diethyl ether soluble fraction less than or equal to 12 wt %, wherein the boiling diethyl ether soluble fraction has a melting enthalpy less than or equal to 4 J/g;

a boiling n-heptane soluble fraction between 15 wt % and 60 wt %, wherein the boiling n-heptane soluble fraction has a melting enthalpy between 10 J/g and 40 J/g; and a boiling n-heptane insoluble fraction between 40 wt % and 85 wt %, wherein the boiling n-heptane insoluble fraction has a melting enthalpy greater than or equal to 45 J/g.

19. The cable of claim 18, wherein the olefin comonomer is ethylene and one or more of 1-butene, 1-pentene, 1-hexene, 1-heptene, 1-octene, 1-nonene, 1-decene, 1-undecene, 1-dodecene, and 4-methyl-1-pentene.

20. The cable of claim 18, wherein the olefin comonomer is ethylene and one of 1-butene, 1-pentene, 1-hexene, 1-heptene, 1-octene, 1-nonene, 1-decene, 1-undecene, 1-dodecene, and 4-methyl-1-pentene.

21. The cable of claim 1, wherein the at least one covering layer has electrically-insulating properties.

22. The cable of claim 1, wherein the at least one covering layer has semiconductive properties.

23. The cable of claim 1, wherein the at least one covering layer comprises a conductive filler.

24. The cable of claim 1, wherein a conductive filler is dispersed in the at least one covering layer.

25. The cable of claim 1, wherein a conductive filler is dispersed in the thermoplastic polymer material.

26. The cable of claim 1, wherein the at least one covering layer is an outer protective sheath.

27. A method of producing a cable comprising at least one conductor, the method comprising the steps of:

selecting a thermoplastic polymer material; and applying at least one covering layer comprising the thermoplastic polymer material around the at least one conductor;

wherein the thermoplastic polymer material comprises:

a propylene homopolymer; or a copolymer of propylene with an olefin comonomer;

wherein the olefin comonomer is ethylene, one or more α-olefins other than propylene, or ethylene and one or more α-olefins other than propylene, wherein the propylene homopolymer or copolymer of propylene has:

a melting point between 140° C. and 165° C.;

a melting enthalpy between 30 J/g and 80 J/g;

a boiling diethyl ether soluble fraction less than or equal to 12 wt %, wherein the boiling diethyl ether soluble fraction has a melting enthalpy less than or equal to 4 J/g;

a boiling n-heptane soluble fraction between 15 wt % and 60 wt %, wherein the boiling n-heptane soluble fraction has a melting enthalpy between 10 J/g and 40 J/g; and a boiling n-heptane insoluble fraction between 40 wt % and 85 wt %, wherein the boiling n-heptane insoluble fraction has a melting enthalpy greater than or equal to 45 J/g.

28. The method of claim 27, herein the at least one covering layer has electrically-insulating properties.

29. The method of claim 27, wherein the at least one covering layer has semiconductive properties.

30. The method of claim 27, wherein the at least one covering layer comprises a conductive filler.

31. The method of claim 27, wherein a conductive filler is dispersed in the at least one covering layer.

32. The method of claim 27, wherein a conductive filler is dispersed in the thermoplastic polymer material.

33. The method of claim 27, wherein the at least one covering layer is an outer protective sheath.

* * * * *

UNITED STATES PATENT AND TRADEMARK OFFICE

CERTIFICATE OF CORRECTION

PATENT NO. : 6,861,143 B2
DATED : March 1, 2005
INVENTOR(S) : Luca Castellani et al.

It is certified that error appears in the above-identified patent and that said Letters Patent is hereby corrected as shown below:

Column 10,
Lines 3, 5 and 7, “cable claim” should read -- cable of claim --
Line 31, “40%” should read -- 40 wt% --.
Line 44, “α-olefins” should read -- α-olefin --.

Column 12,
Line 48, “herein” should read -- wherein --.

Signed and Sealed this

Seventh Day of June, 2005

JON W. DUDAS
*Director of the United States Patent and Trademark Office*